US008813737B2

(12) United States Patent
Langley

(10) Patent No.: US 8,813,737 B2
(45) Date of Patent: Aug. 26, 2014

(54) CABLE GUARD WITH TWO PIECE SLIDER

(71) Applicant: Bear Archery, Inc., Evansville, IN (US)

(72) Inventor: Timothy W. Langley, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 99 days.

(21) Appl. No.: 13/659,961

(22) Filed: Oct. 25, 2012

(65) Prior Publication Data

US 2013/0104865 A1 May 2, 2013

Related U.S. Application Data

(60) Provisional application No. 61/552,761, filed on Oct. 28, 2011.

(51) Int. Cl.
*F41B 5/14* (2006.01)
*F41B 5/10* (2006.01)

(52) U.S. Cl.
CPC ... *F41B 5/10* (2013.01); *F41B 5/14* (2013.01); *F41B 5/1403* (2013.01)
USPC ..... 124/88; 124/25.6; 124/86

(58) Field of Classification Search
CPC ..... F41B 5/14; F41B 5/10
USPC ..... 124/25.6, 86, 88
See application file for complete search history.

(56) References Cited

U.S. PATENT DOCUMENTS 4,452,222 A 6/1984 Quartino et al.
4,542,732 A 9/1985 Troncoso
4,596,228 A * 6/1986 Smith ..... 124/25.6
4,834,061 A 5/1989 Chattin
4,886,038 A * 12/1989 Betters ..... 124/25.6
4,903,678 A * 2/1990 Walker ..... 124/90
4,917,070 A * 4/1990 Townsend ..... 124/23.1
4,919,108 A * 4/1990 Larson ..... 124/88
5,415,154 A 5/1995 Angeloni
5,531,211 A 7/1996 Wilfong, Jr.
5,553,600 A * 9/1996 Miller ..... 124/86
5,651,355 A * 7/1997 Gallops, Jr. ..... 124/25.6
5,983,880 A * 11/1999 Saunders ..... 124/25.6
6,659,096 B1 12/2003 Nealy, Sr. et al.
6,681,753 B2 1/2004 Afshari
6,708,684 B2 3/2004 Chattin
6,722,354 B1 * 4/2004 Land ..... 124/25.6
6,758,204 B1 * 7/2004 Goff et al. ..... 124/25.6
6,763,820 B1 7/2004 Pinto, Jr.
6,792,930 B1 * 9/2004 Kronengold et al. ..... 124/25.6
6,889,679 B2 * 5/2005 Chattin ..... 124/25.6

(Continued)

*Primary Examiner* — Gene Kim
*Assistant Examiner* — Alexander Niconovich
(74) *Attorney, Agent, or Firm* — Woodard, Emhardt, Moriarty, McNett & Henry LLP

(57) ABSTRACT

Archery bow arrangements described herein include an archery bow body defining opposing limb tips and rotational elements mounted at the limb tips. A bowstring and additional cable portions extend between the limb tips. A cable guard extends from the archery bow body. The cable guard includes two slider pieces which each engage one portion of the cable arrangement and which can each separately translate forward or rearward during the bow's draw and release cycle. The slider pieces can preferably translate relative to each other, yet can each form limits to the translation of the other slider. Preferably, each slider is slidable to allow the respective cable portion to remain substantially straight or imparts only a minimal forward or rearward bend angle during the bow's draw and release cycle.

20 Claims, 5 Drawing Sheets

(56) References Cited

U.S. PATENT DOCUMENTS

| | | | | |
|---|---|---|---|---|
| 6,904,900 | B2 * | 6/2005 | Gallops, Jr. | 124/25.6 |
| 7,913,678 | B2 | 3/2011 | Hudkins | |
| 8,006,679 | B2 | 8/2011 | Strother | |
| 8,028,685 | B2 * | 10/2011 | Clark | 124/25.6 |
| 8,176,906 | B2 * | 5/2012 | Simo et al. | 124/25.6 |
| 8,281,773 | B2 * | 10/2012 | Dahl et al. | 124/25.6 |
| 8,307,816 | B2 * | 11/2012 | Darlington | 124/88 |
| 8,371,283 | B2 * | 2/2013 | Grace et al. | 124/88 |
| 8,402,960 | B2 * | 3/2013 | McPherson | 124/88 |
| 8,424,511 | B2 * | 4/2013 | Grace et al. | 124/88 |
| 8,485,169 | B2 * | 7/2013 | Dahl, II | 124/25.6 |
| 8,616,189 | B2 * | 12/2013 | McPherson et al. | 124/88 |
| 2007/0151552 | A1 * | 7/2007 | Czemske et al. | 124/86 |
| 2008/0236556 | A1 | 10/2008 | Sims et al. | |
| 2009/0183720 | A1 | 7/2009 | Hudkins | |
| 2009/0255520 | A1 | 10/2009 | Strother | |
| 2009/0320816 | A1 | 12/2009 | Strother | |
| 2010/0132683 | A1 * | 6/2010 | Darlington | 124/25.6 |
| 2010/0132685 | A1 * | 6/2010 | De Sousa | 124/88 |
| 2010/0263650 | A1 * | 10/2010 | Dahl et al. | 124/25.6 |
| 2010/0282226 | A1 * | 11/2010 | Marzullo | 124/25.6 |
| 2011/0048394 | A1 * | 3/2011 | Simo et al. | 124/25.6 |
| 2012/0042861 | A1 * | 2/2012 | Anselmo | 124/25.6 |
| 2013/0055997 | A1 * | 3/2013 | Badgerow | 124/88 |
| 2013/0061838 | A1 * | 3/2013 | Gordon et al. | 124/25.6 |

* cited by examiner

CABLE GUARD WITH TWO PIECE SLIDER

This application claims the benefit of provisional application U.S. 61/552,761, filed on Oct. 28, 2011.

FIELD OF THE INVENTION

The present invention relates generally to archery bows and more particularly pertains to a cable guard for use with and mounted to archery bows.

BACKGROUND OF THE INVENTION

Certain archery bows, such as compound bows, store energy by a cable arrangement involving a bowstring, rotational elements and additional cable portions extending between the respective ends of the bow. In certain arrangements, cable guards are used to engage the cable arrangements to provide clearance, assisting the bowstring and an arrow to be drawn and released without interference from other cable portions.

SUMMARY OF THE INVENTION

Figure 1:
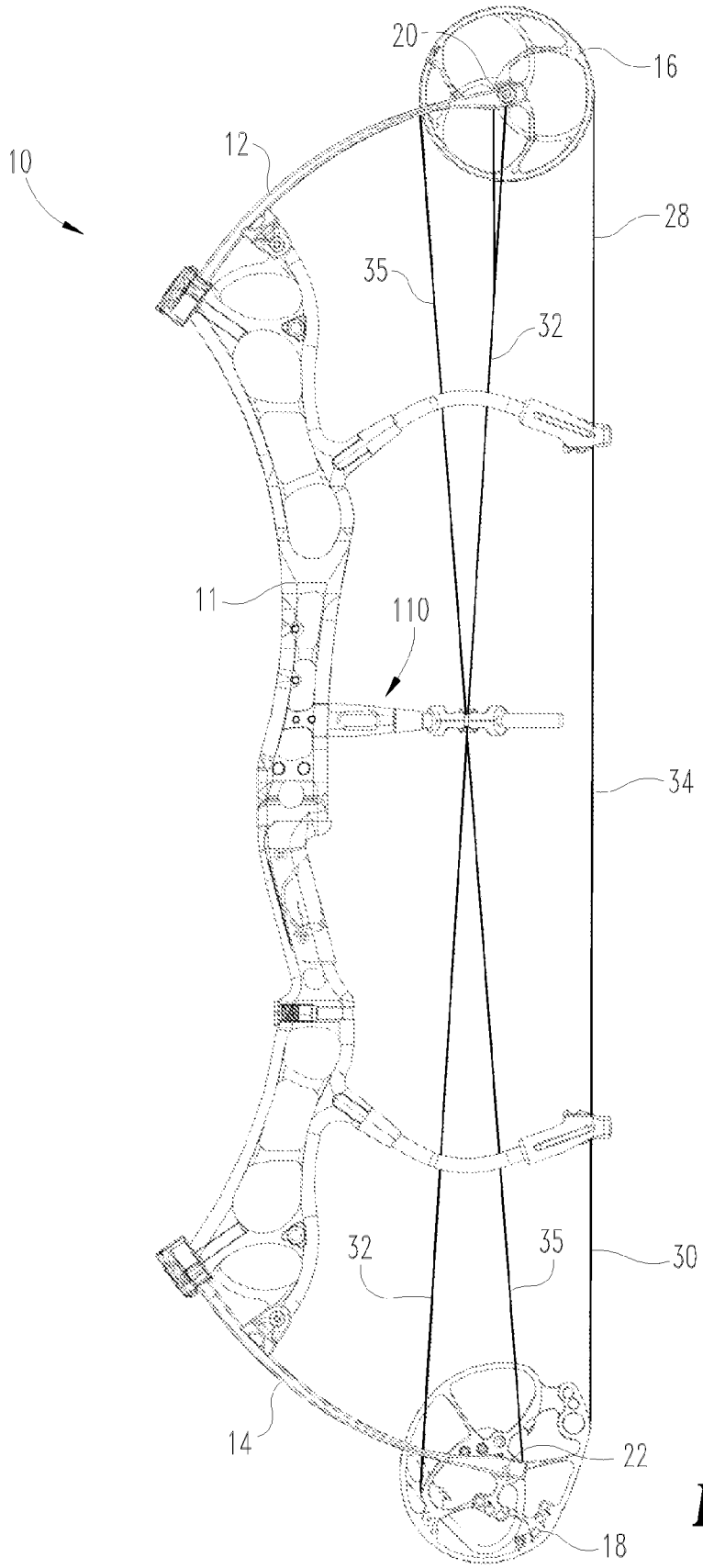
FIG. 1 is a perspective view of a single cam bow in an undrawn position incorporating a cable guard according to a preferred embodiment of the present disclosure.

Archery bow arrangements according to certain preferred embodiments described herein include an archery bow body defining opposing limb tips and rotational elements mounted at the limb tips. A bowstring and additional cable portions extend between the limb tips. A cable guard extends from the archery bow body. The cable guard includes two slider pieces which each engage one portion of the cable arrangement and which can each separately translate forward or rearward during the bow's draw and release cycle. The slider pieces can preferably translate relative to each other, yet can each form limits to the translation of the other slider. Preferably, each slider is slidable to allow the respective cable portion to remain substantially straight or imparts only a minimal forward or rearward bend angle during the bow's draw and release cycle.

In certain embodiments, a cable guard assembly for an archery bow comprises an arm mountable to an archery bow body. A first slider is slidably mounted on the arm and has an adjustable range in forward and rearward directions. The first slider is engageable with a first cable portion to retain the cable portion laterally outward from a plane defined by the archery bow body and the bowstring. A second slider is slidably mounted to the cable guard assembly and also has an adjustable range in forward and rearward directions. The second slider is engageable with a second cable portion to retain the cable portion laterally outward from the plane defined by the archery bow body and the bowstring. The second slider may be mounted between two end portions of the first slider.

In one form, an archery bow assembly comprises an archery bow body, an upper limb, a lower limb, a bowstring extending between the limbs, and at least two non-bowstring cable portions extending between the limbs. The cable guard assembly has an arm extending from the archery bow body and includes two sliders each engaging a non-bowstring cable portion. A first slider defines an interior open area between two end portions and a second slider is slidably mounted within the interior open area.

In a further embodiment, a cable guard includes an arm mountable to an archery bow body. An outer slider is slidably mounted on the arm and includes two spaced-apart ends and a connecting member between the ends. The connecting member defines an outer cable engagement point. An inner slider may be slidably mounted on the arm between the two ends and defines an inner cable engagement point.

Other objects and attendant advantages will be readily appreciated as the same become better understood by references to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

Embodiments of the present disclosure include a cable guard for an archery bow with two-piece sliders. In certain embodiments a first cable portion engages a first slider which can translate rearward or forward during the bow's draw and release cycle. A second cable portion engages a second slider which can separately translate rearward or forward during the draw and release cycle. Preferably, each slider retains one cable portion and is slidable to allow the respective cable portion to remain substantially straight or imparts only a minimal forward or rearward bend angle during the bow's draw and release cycle.

FIG. 1 illustrates an example of a conventional single cam compound archery bow generally designated as 10. When viewed from the perspective of an archer holding the bow, it includes a riser 11 with a handle, an upper limb portion 12 and a lower limb portion 14 forming a bow body. In the single cam example illustrated, rotational members such as idler wheel 16 and eccentric cam 18 are supported at the limb tip sections for rotary movement about axles 20 and 22. In the embodiment shown, upper and lower limbs are formed of parallel and symmetric limb portions sometimes called quad limbs. Alternately, a single piece limb can have a notch or slot area removed to allow a rotational element to be mounted to the limb tip. An upper pulley axle 20 is carried between the outer limb tip portions of upper limb 12. A lower pulley axle 22 is carried between the outer limb tip portions of lower limb 14.

The portion of the cable which defines the bowstring cable 34 includes an upper portion 28 and a lower end portion 30 which are fed-out from idler wheel 16 and cam 18 when the bow is drawn. The upper end portion 28 is part of a longer cable which has a medial portion mounted around idler wheel 16 with the ends mounted to cam 18. The non-bowstring portion of the cable extending from wheel 16 to cam 18 can be referred to as the return cable portion 35. Additionally, a y-yoke anchor cable 32 has a lower end mounted to cam 18 which extends to two upper ends mounted adjacent opposing ends of axle 20. Each cable has a thickness and one or more strands forming a round cross-section defining a circumference.

From the perspective of the archer, the bowstring is considered rearward relative to the riser which defines forward. Further, inward is considered towards the plane of the bowstring and arrow while outward means away from the plane. Directional references herein are for ease of explanation and are not intended to be limiting. Similarly, a bow riser handle held with the left hand is illustrated, but is not intended to be limiting. A symmetric arrangement can be used with a bow having a right-handed riser.

Figure 2:
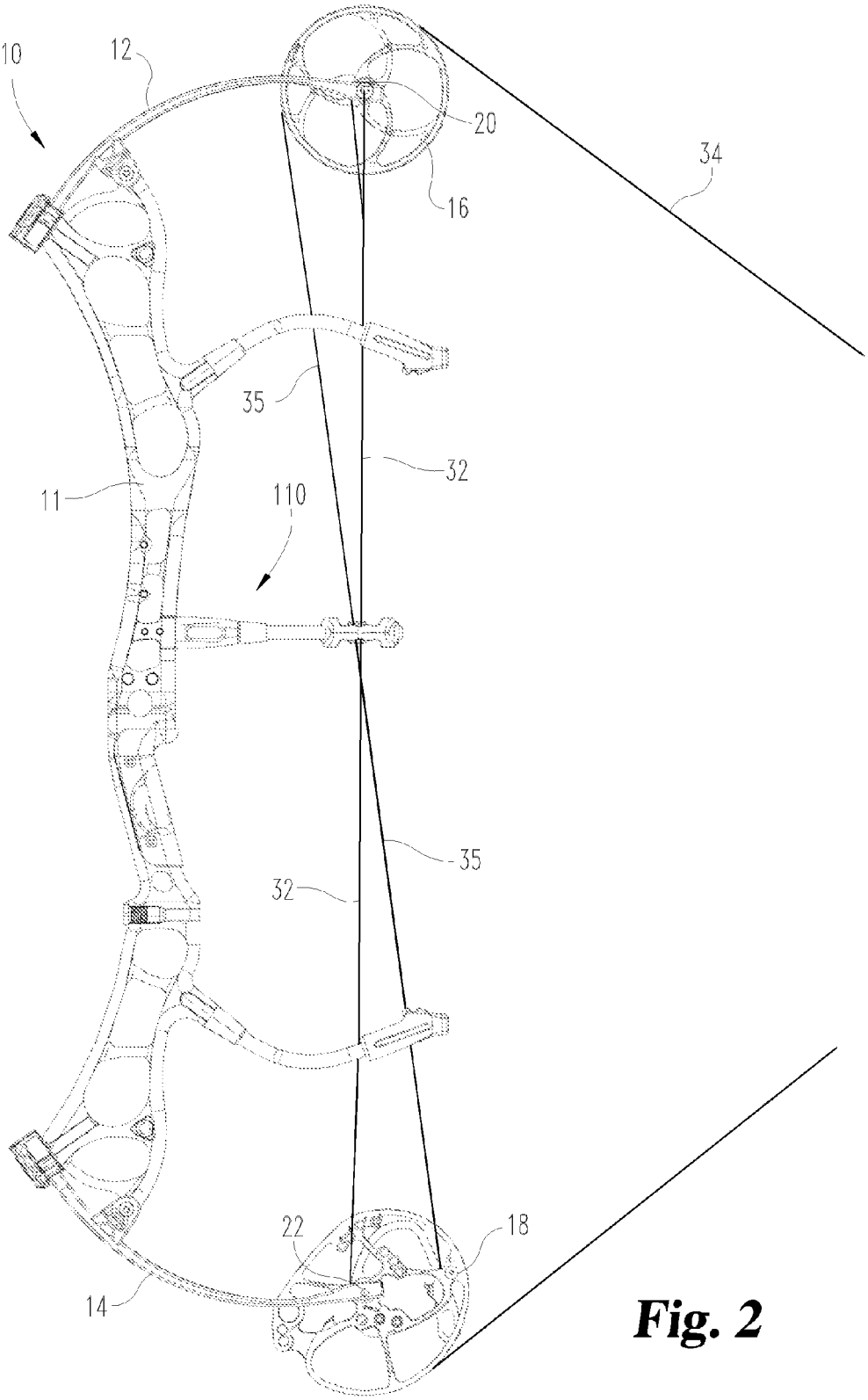
FIG. 2 is a view of the bow of FIG. 1 in a drawn position.

When the bowstring 34 is drawn as illustrated in FIG. 2, it causes idler wheel 16 and cam 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing idler wheel 16 and cam 18 to rotate in the opposite direction, to take up the bowstring 34 and launch the arrow with an amount of energy proportional to the energy initially stored in the bow limbs. Bow 10 is described for illustration and context and is not intended to be limiting.

Certain embodiments can also be used with dual or two cam compound bows. A two cam bow includes a similar riser with a handle, upper limb portions and lower limb portions. Rotational members such as an upper eccentric cam and a lower eccentric cam are supported at the limb tip sections for rotary movement about their axles. A bowstring cable includes an upper end mounted to and fed-out from the upper cam and a lower end mounted to and fed-out from the lower cam when the bow is drawn. A return cable portion has an upper end mounted to the upper cam and a lower end mounted to the lower cam, with the lower end fed-out from cam and the upper end of the cable wrapped or taken into cam as the bow is drawn. Additionally, a y-yoke anchor cable has a lower end mounted to the lower cam and two upper ends mounted to the axle of the upper cam. The lower end is taken in to the lower cam as the bow is drawn. References herein to a bowstring or cable portion extending to the limb tips are intended to broadly include a cable portion wrapped around or mounted to a track of a rotational element or an attachment to an axle mounted at the limb tips.

The present disclosure can also be used in other types of bows, for example hybrid cam bows, binary cam bows, or crossbows, which are considered conventional for purposes of the present invention. For convenience, the combination of riser 11 and either single or quad limbs forming upper limb 12 and lower limb 14 may generally be referred to as an archery bow body. It should be appreciated that the archery bow body can take on various designs in accordance with the many different types of bows.

In the illustrated embodiments, a cable guard 110 as seen in FIGS. 1-2, extends rearward from the bow body, typically from the riser 11. The cable guard generally engages one or more cable portions and retains them laterally outward from the plane which includes the bowstring and arrow, thus providing clearance, assisting the bowstring and arrow to be drawn and released without interference from the cable portions.

Figure 3:
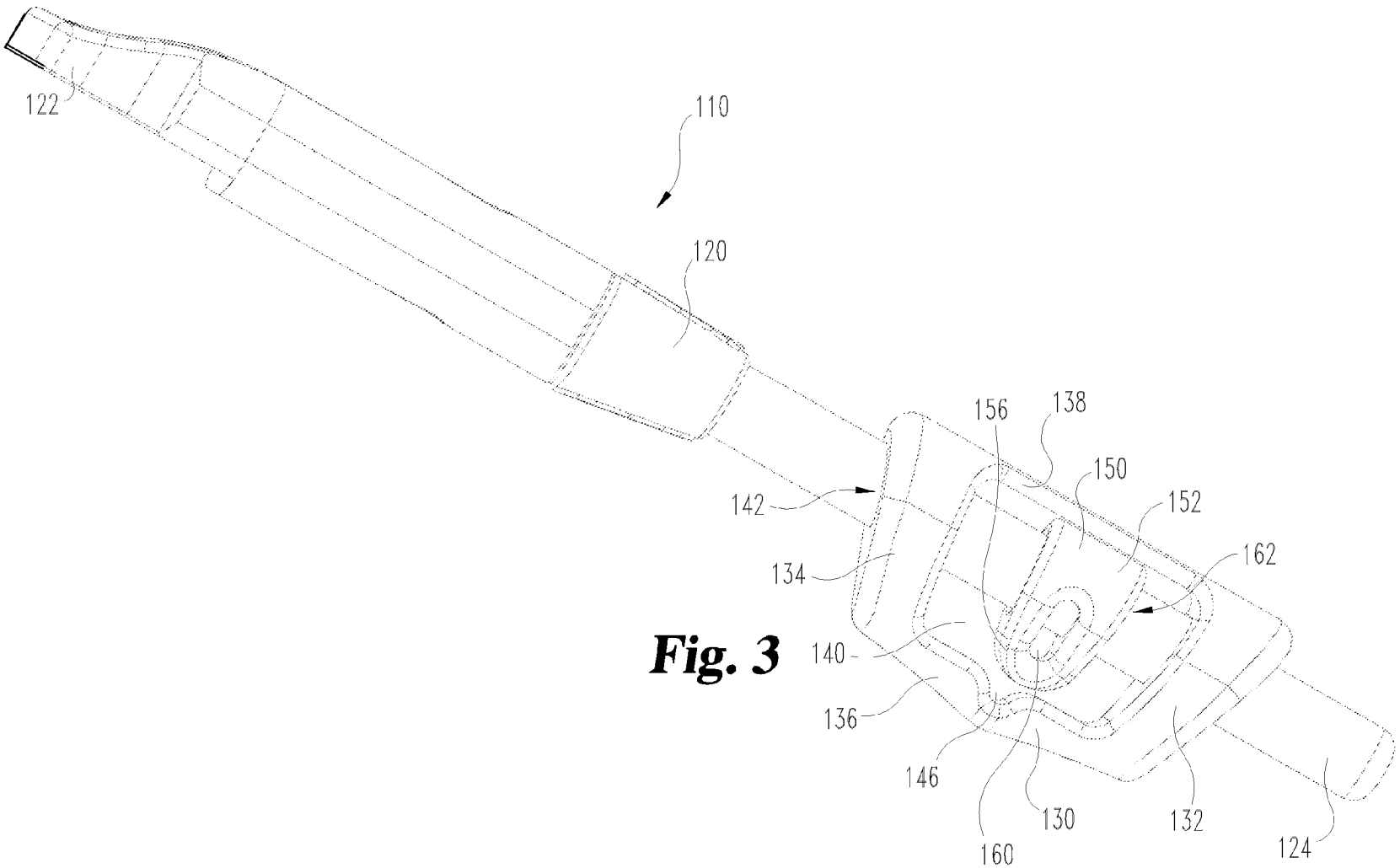
FIG. 3 is an upper, perspective view of the cable guard of FIG. 1.
Figure 4:
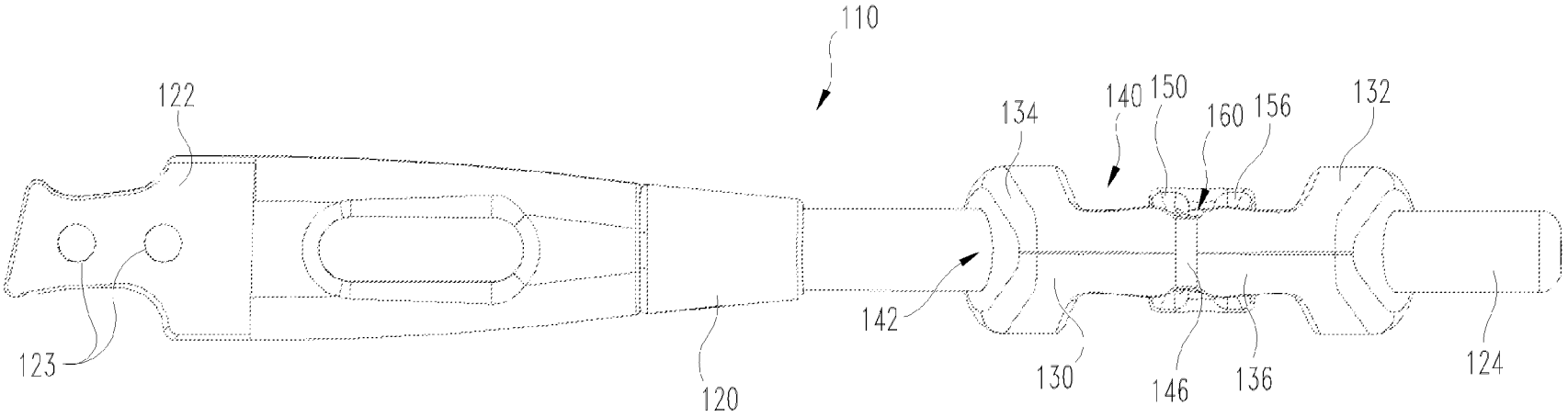
FIG. 4 is a side view of the cable guard of FIG. 3.
Figure 5:
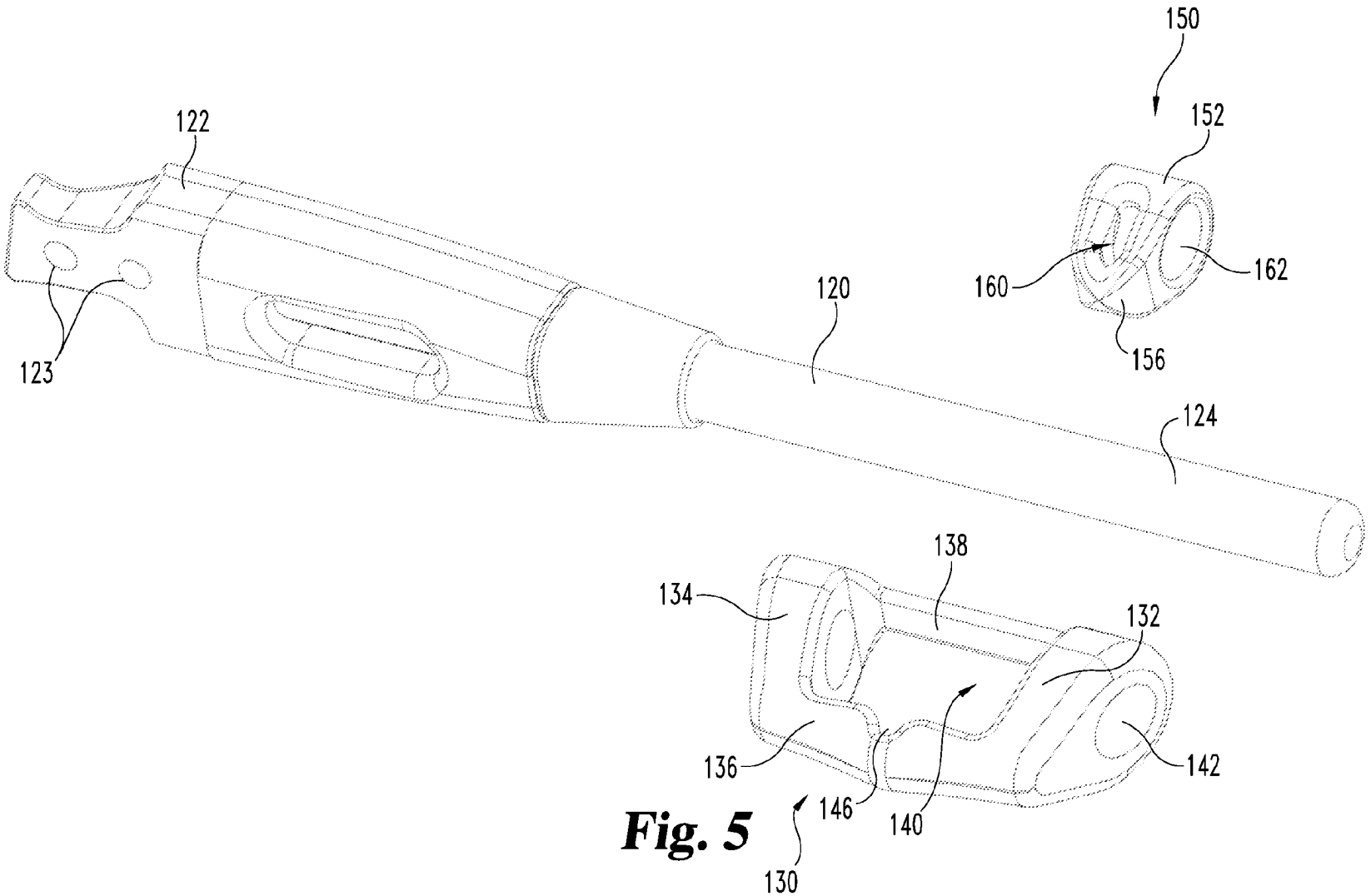
FIG. 5 is an exploded view of the cable guard of FIG. 3.

Cable guard 110 as more clearly seen in FIGS. 3-5, includes an arm portion 120 having a forward end portion 122 mounted or mountable to the bow body and a rearward end portion 124. Alternately, arm portion 120 may have a forward end portion integral with the bow body. In the example illustrated, forward end portion 122 includes two openings 123 which can interact with fasteners to rigidly mount cable guard 110 to riser 11. Forward end 122 may have various profiles as desired for a preferred mounting arrangement, for example using a tapered profile as illustrated or simply having a rectangular profile. Preferably arm portion 120 has a rigid structure.

In the illustrated embodiment, rearward portion 124 is formed having a cylindrical rod portion with a substantially horizontal longitudinal axis extending generally forward and rearward. Slidably mounted on rearward portion 124 are an outer slider 130 and an inner slider 150. In alternate embodiments, arm portion 120 may be bent or curved, and may allow the slider pieces to translate along a curved or arcuate path. Alternately, the sliders may use rollers, grooves or low-friction bearing arrangements to facilitate translation.

Outer slider 130 is generally formed of a body having a rearward side or end portion 132, a forward side or end portion 134, an inward side 136 and an outer side 138. An interior open area 140 may be defined within the sides of the slider. Open area 140 optionally yet preferably defines a desired cable engagement point, such as notch 146, on the interior face of inward side 136.

Rod passage 142 is defined along a substantially horizontal longitudinal axis in a forward and rearward direction through rearward side 132, forward side 134 and open area 140. Rod passage 142 is preferably sized and shaped to receive and engage the rearward portion 124 of arm 120. The engagement of rod passage 142 to rearward portion 124 preferably allows outer slider 130 to slide rearwardly or forwardly along rearward portion 124.

Inner slider 150 is generally formed with a body portion 152. An interior open area 160 may be defined within an encircling portion 156, typically arranged towards the inward side of slider 150. Open area 160 optionally yet preferably defines a cable engagement point, such as a slot or notch, on the interior facing inward side of open area 160.

Rod passage 162 is defined along a substantially horizontal longitudinal axis in a forward and rearward direction through the body of inner slider 150. Rod passage 162 is preferably sized and shaped to receive and engage the rearward portion 124 of arm 120. The engagement of rod passage 162 to rearward portion 124 preferably allows inner slider 150 to slide rearwardly or forwardly along rearward portion 124.

In certain preferred embodiments, rod portion 124 and respective rod passages 142 and 162 are circular or cylindrical in cross-section, enabling outer slider 130 and inner slider 150 to rotate around and/or slide along rod portion 124 if desired. Alternately, rod portion 124 and rod passages 142 and 162 may have non-circular cross-sections, such as a polygonal or eccentric shape or a tab and groove arrangement, inhibiting rotation of sliders 130 and 150 relative to rod portion 124.

In some embodiments, the position of one slider limits the movement range of another slider. For instance, the movement range of the inner slider may be limited by end portions of the outer slider. In such an arrangement, the position of the inner slider is limited in both forward and rearward directions. Alternately, each slider may limit the movement range of the other in both forward and rearward directions.

As illustrated, inner slider 150 is nested within yet independently slideable to translate relative to and between the inner faces of the end portions, namely rearward side 132 and forward side 134 of outer slider 130. The movement range of inner slider 150 is defined by the then-current position of the outer slider 130, which may change position during the draw and release cycle of the bow. Conversely, the movement range of the outer slider 130 is limited by the then-current position of the inner slide 150 which may change position.

According to certain embodiments, the cable guard assembly includes an arm. A first slider is slidably mounted on the arm and has an adjustable range in both forward and rearward directions. A second slider is slidably mounted to the cable guard assembly and also has an adjustable range in both forward and rearward directions. As illustrated, the second slider is mounted on the arm. Alternately, the second slider may be slidably mounted to the first slider.

In other options, at least one slider may include a cable engagement point, such as a groove or notch. The cable engagement point may have an adjustable movement range corresponding to the movement range of the slider. However, the cable engagement point may be adjustable without changing the position of any other slider. In certain arrangements, both sliders each define a cable engagement point and each cable engagement point has an adjustable movement range. The adjustable movement ranges of the cable engagement points may overlap in the forward-to-rearward direction to some extent.

Portions of the cable arrangement, for example the anchor cable 32 and the return cable 35 preferably each pass through one of outer slider 130 and inner slider 150, with one cable portion engaging each of the respective cable engagement points on inner slider 130 and outer slider 150. During the draw and release cycle, the cables may travel vertically upward or downward through the sliders, yet are retained laterally outward to be held out of the way of the arrow and bowstring during a release of an arrow.

Preferably, each slider retains one cable portion and is slidable to allow the respective cable portion to remain substantially straight or imparts only a minimal forward or rearward bend angle during the bow's draw and release cycle. In this arrangement, the respective cable portions, viewed from the perspective perpendicular to the plane defined by the riser and bowstring, such as the views illustrated in FIG. 1 and FIG. 2, remain substantially straight between the limb tips without significant forward or rearward bends where the sliders engage the cable portions. When viewed from the perspective of the plane defined by the riser and bowstring, the cable portions may be bent in order to retain cable portions laterally outward from said plane during the draw and release cycle of the bow.

Preferably there is minimal translation friction between the sliders and the arm and between the sliders and the cables. Optionally, low friction materials such as a Teflon® coating or self-lubricating materials such as Delrin® plastic may be used to form the sliders and/or the arm. Cables may be formed from low friction or self-lubricating materials, including high-modulus polyethelene. Lubricious coatings may also reduce friction between the cables and the sliders and/or the sliders and the arm. According to other aspects of the invention, one or more sliders may have a cable engagement point that includes a wheel, pulley, or other rotational element facilitating upward and downward translation of the cables through the sliders during the draw and release cycle.

In certain embodiments, a portion of one cable, such as anchor cable 32 in a single cam arrangement, is retained by outer slider 130, while a different cable portion, such as return cable 35, is retained by the inner slider 150. In a brace or undrawn position, the cables each engage and are retained by a slider in a first position. As the bow and bowstring are moved to a drawn position, the limb tips will correspondingly move horizontally and vertically along an arcuate path and the rotational elements in the limb tips will pivot. The combined movement of the limb tips and pivoting of the rotational elements will cause the respective retained cables to move linearly through the respective cable pairs and will also change the forward and rearward orientation of the respective cable ends between the portions extending towards the respective limb tips from the cable bend point. This movement of the cable ends changes the alignment of the respective cables relative to the cable guard, which is conveyed as forward or rearward pressure applied to the respective sliders. The applied pressure correspondingly causes the respective slider piece to translate rearwardly or forwardly along rearward portion 124, preferably in a manner that minimizes any forward or rearward bend angle imparted to the cable. This translation movement accommodates the applied rearward and/or forward force and substantially reduces or eliminates the forward or rearward force of the cables against the sliders.

In certain embodiments, inner slider and outer slider each define a cable engagement point. In a brace or undrawn position, the cable engagement points may define a forward-to-rear ordering. For example, the cable engagement point of the outer slider may be closer to the riser than the cable engagement point of the inner slider, while the cable engagement point of the inner slider may be closer to the bowstring than the cable engagement point of the outer slider. As the bow and bowstring are moved to a drawn position, combined movement of the limb tips and rotational elements will cause the retained cables to move linearly. The sliders and their respective cable engagement points may also move accordingly. This movement may, in certain arrangements, cause the forward-to-rearward ordering of the cable engagement points to reverse at least once during the draw and release cycle of the bow.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cable guard assembly for an archery bow, comprising:

an arm mountable to an archery bow body including a bowstring, a first cable portion, and a second cable portion; and a first slider slidably mounted on the arm and having an adjustable range in forward and rearward directions, wherein said first slider is engagable with the first cable portion to retain the first cable portion laterally outward from a plane defined by the archery bow body and the bowstring; and a second slider slidably mounted to the cable guard assembly and having an adjustable range in forward and rearward directions, wherein said second slider is engagable with a second cable portion to retain the second cable portion laterally outward from a plane defined by the archery bow body and the bowstring;

wherein the first slider defines two end portions and wherein the second slider is independently slideable between the two end portions.

2. The cable guard assembly of claim 1, wherein the first slider defines a first cable engagement point, wherein the second slider defines a second cable engagement point wherein the first cable engagement point and the second engagement point define a forward-to-rearward ordering along said arm, and wherein the sliders are slidably mounted such that the relative forward-to-rearward ordering of the cable engagement points is reversible.

3. The cable guard assembly of claim 1, wherein the position of the first slider limits the adjustable range of the second slider, wherein the position of the second slider limits the adjustable range of the first slider.

4. The cable guard assembly of claim 3, wherein the position of one slider limits the adjustable range of the other slider in both forward and rearward directions.

5. The cable guard assembly of claim 1, wherein at least one slider defines a cable engagement point.

6. The cable guard assembly of claim 5, wherein the position of the cable engagement point of one slider is translatable without translation of the other slider.

7. The cable guard assembly of claim 1, wherein the second slider is slidably mounted on the arm.

8. The cable guard assembly of claim 1, wherein the first slider defines an interior open area between the two end portions, wherein the second slider is slidably mounted within the interior open area.

9. An archery bow assembly, comprising:

an archery bow body including an upper limb and a lower limb;

a bowstring extending between the upper limb and the lower limb;

at least two non-bowstring cable portions extending between the upper limb and the lower limb; and a cable guard assembly having an arm extending from the archery bow body, a first slider slidably mounted on the arm, the first slider engaging a first of said non-bowstring cable portions, and a second slider slidably mounted on the arm, the second slider engaging the second of said non-bowstring cable portions;

wherein the first slider and the second slider retain the first cable portion and the second cable portion, respectively, laterally outward from the plane defined by the archery bow body and the bowstring;

wherein the first slider defines an interior open area between two end portions and wherein the second slider is independently slideable within the interior open area.

10. The archery bow assembly of claim 9, wherein the position of the first slider limits the movement range of the second slider in both forward and rearward directions.

11. The archery bow assembly of claim 9, wherein the position of the second slider limits the movement range of the first slider in both forward and rearward directions.

12. The archery bow assembly of claim 9, wherein the sliders each translate along said arm to allow translation of the cable portions forward and rearward relative to said arm during the draw and release cycle of the archery bow assembly to enable the respective cable portions to remain substantially straight between the upper limb and the lower limb throughout the draw and release cycle of the archery bow assembly.

13. The archery bow assembly of claim 9, wherein the first slider and the second slider each define a cable engagement point;

wherein in a first position corresponding to the brace position of the archery bow assembly, the cable engagement points define a relative forward-to-rearward ordering;

wherein in a second position corresponding to the drawn position of the archery bow assembly, the relative forward-to-rearward ordering is reversed.

14. The archery bow assembly of claim 9, wherein translation of the first slider corresponding to translation of the first cable portion during the draw and release cycle of the archery bow assembly substantially reduces the forward and rearward force of the first cable portion against the first slider;

wherein translation of the second slider corresponding to translation of the second cable portion during the draw and release cycle of the archery bow assembly substantially reduces the forward and rearward force of the second cable portion against the second slider.

15. The archery bow assembly of claim 9, wherein translation of the first slider corresponding to translation of the first cable portion during the draw and release cycle of the archery bow assembly minimizes forward and rearward bend angles along the first cable portion;

wherein translation of the second slider corresponding to translation of the second cable portion during the draw and release cycle of the archery bow assembly minimizes forward and rearward bend angles along the second cable portion.

16. A cable guard for an archery bow, comprising:

an arm mountable to an archery bow body having an upper limb, a lower limb, a bowstring, and at least two non-bowstring cable portions extending between the upper limb and lower limb;

an outer slider slidably mounted on the arm, wherein the outer slider has two spaced-apart ends and a connecting member between the two ends, wherein the connecting member defines an outer cable engagement point; and an inner slider slidably mounted on the arm between the two spaced-apart ends, wherein the inner slider defines an inner cable engagement point; and wherein the inner slider is slidable independent of the outer slider.

17. The cable guard of claim 16, wherein the position of the inner slider defines the movement range of the outer slider; wherein the position of the outer slider defines the movement range of the inner slider.

18. The cable guard of claim 16, wherein the movement range of the outer slider defines an adjustable movement range of the outer cable engagement point, wherein the movement range of the inner slider defines an adjustable movement range of the inner cable engagement point, wherein the adjustable movement ranges of the cable engagement points at least partially overlap in the forward-to-rearward dimension.

19. The cable guard of claim 16, wherein the position of at least one slider limits the movement range of the other slider in both forward and rearward directions.

20. The cable guard of claim 16, wherein the positions of the cable engagement points define a relative forward-to-rearward ordering along said arm, wherein at least one slider is slidably mounted so that translation of that slider is capable of reversing the relative forward-to-rearward ordering of said cable engagement points.

* * * * *